United States Patent [19]

Guy et al.

[11] 4,257,734

[45] Mar. 24, 1981

[54] GUIDE VANES FOR GAS TURBINE ENGINES

[75] Inventors: Kenneth R. Guy; Terence W. Broom, both of Bristol; Peter J. Maggs, Midsomer Norton, nr. Bath, all of England

[73] Assignee: Rolls-Royce Limited, London, England

[21] Appl. No.: 17,556

[22] Filed: Mar. 5, 1979

[30] Foreign Application Priority Data

Mar. 22, 1978 [GB] United Kingdom ..... 11529/78

[51] Int. Cl.[3] ..... F01D 5/18; F01D 5/14

[52] U.S. Cl. ..... 415/115; 416/96 A

[58] Field of Search ..... 416/96 A; 415/115

[56] References Cited

U.S. PATENT DOCUMENTS

| | | | |
|---|---|---|---|
| 2,779,565 | 1/1957 | Bruckmann | 416/96 A |
| 3,369,792 | 2/1968 | Kraimer et al. | 415/115 |
| 3,540,810 | 11/1970 | Hercher | 416/96 A |
| 3,623,318 | 11/1971 | Shank | 416/96 A |
| 4,063,851 | 12/1977 | Weldon | 416/96 A |
| 4,183,716 | 1/1980 | Takahara | 416/96 A |

FOREIGN PATENT DOCUMENTS

| | | | |
|---|---|---|---|
| 1366704 | 9/1974 | United Kingdom | 416/96 A |
| 1530256 | 10/1978 | United Kingdom | 416/96 A |

*Primary Examiner*—William L. Freeh

*Attorney, Agent, or Firm*—Stevens, Davis, Miller & Mosher

[57] ABSTRACT

A vane for a gas turbine engine comprising a hollow body externally of aerofoil form. The inner surface of the body is provided with confronting grooves, extending in a direction along the length of the aerofoil form, at a location intermediate the leading and trailing edges of the aerofoil form for receiving two inserts. The first insert comprises two perforated panels situated inside a trailing region of the aerofoil form and defining therewith one or more air passages between the insert and the wall of the body. The first insert has portions which engage in the grooves in the wall of the body, and is provided with confronting grooves extending in a direction along the length of the aerofoil form at a location intermediate the leading and trailing edges of the aerofoil form. The second insert comprises a first panel extending across the void in the body, and has edges which engage in the confronting grooves in the first insert. The second insert has a second panel closing at least part of an end of the void in the body.

8 Claims, 5 Drawing Figures

GUIDE VANES FOR GAS TURBINE ENGINES

DESCRIPTION

This invention relates to a vane for gas turbine engines.

There is a need to provide efficient cooling of stator vanes, such as nozzle guide vanes, in gas turbine engines. A well known method of making such vanes is to cast them as a unitary construction with a single large internal cavity through which air is flowed to cool the vane. Ideally the air flow should be concentrated over the internal surface of the vane to achieve efficient cooling. It is impossible to do this with a single large cavity.

An object of the present invention is to provide structure within the cavity of a hollow vane for a gas turbine engine to improve the distribution of cooling air over the internal surface of cavity of the vane.

According to the present invention there is provided a vane for a gas turbine engine, the vane comprising: a hollow body externally of aerofoil form, the inner surface of which is provided with confronting grooves extending in a direction along the length of the aerofoil form at a location intermediate the leading and trailing edges of the aerofoil form; a first insert comprising two perforated panels situated inside a trailing region of the aerofoil form and defining therewith one or more air passages between the insert and the wall of the body, the first insert having portions which engage in the grooves in the wall of the body, and the first insert being provided with confronting grooves extending in a direction along the length of the aerofoil form at a location intermediate the leading and trailing edges of the aerofoil form; and a second insert comprising a first panel extending across the void in the body, the second insert having edges which engage in the confronting grooves in the first insert and having a second panel closing at least part of an end of the void in the body.

By virtue of said grooves in the first insert the first panel of the second insert is insertable into position between said edge portions by being slid along said grooves, the second panel of the second insert attaining its closing position at the spanwise end of the void in the body as the first panel attains its fully inserted position.

The void within the hollow body may be of approximately aerofoil shape complementary to the exterior aerofoil form in which case the two panels of the first insert converge towards the trailing edge of the aerofoil form, and the first panel of second insert extends across between the diverging edges of the first insert.

The hollow body may have an end wall effectively closing off a least part of one end of the void inside the body. For example, the end wall may effectively close off one end of the void formed at the leading edge side of the first panel of the second insert, and the second panel of the second insert may effectively close off the void formed at the trailing edge side of the first panel of the second insert at an end of the body opposite to that at which the said end wall is provided.

Preferably the first insert comprises a single member although the first insert may comprise two or more components which are connected together.

The void within the body may be wider at a location intermediate the ends of the body than at the ends of the body and in this case, the panels of the first insert may be shaped to conform to the internal shape of the void so as to define a substantially uniform gap between the first insert and the wall of the body.

The inner wall of the hollow body may be provided with one or more additional spaced sets of confronting grooves extending in a direction along the length of the aerofoil form. In this case an insert may be provided which extends across the void within the body to engage in the, or each, set of additional grooves.

Examples of vanes according to this invention will now be described with reference to the accompanying drawings wherein.

Figure 1:
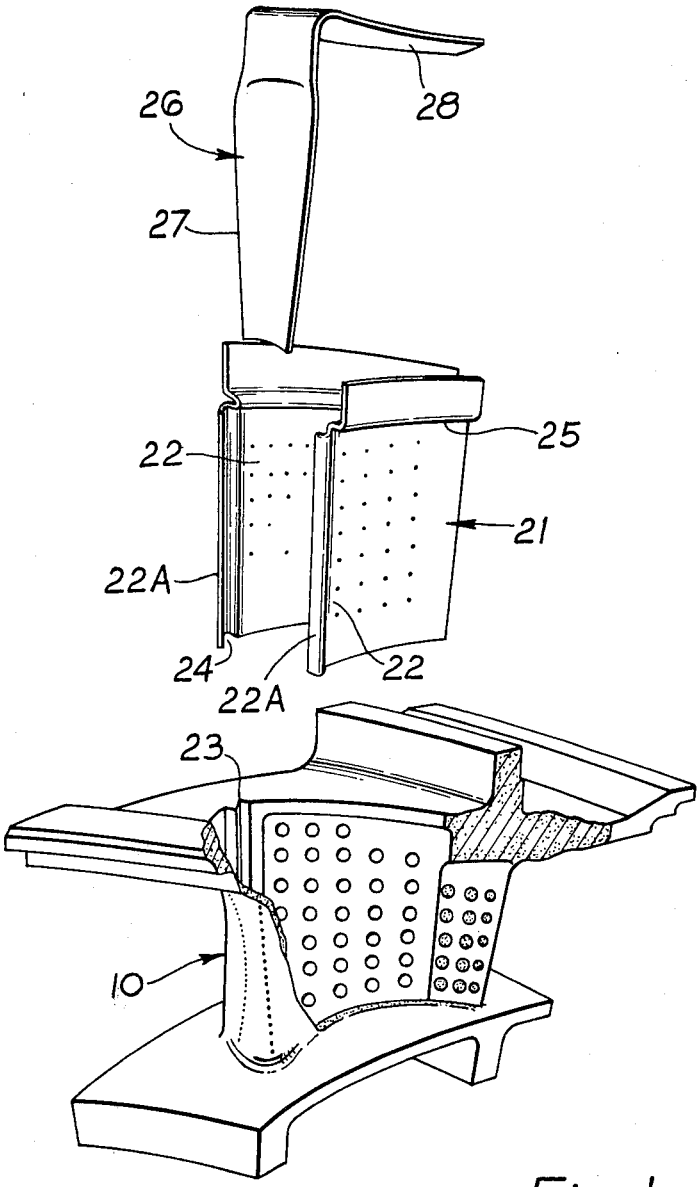
FIG. 1 is an exposed perspective view of the vane.

Referring to the drawings the vane comprises a hollow body 10 being a casting exteriorly of aerofoil shape (FIG. 3) and interiorly of approximate complementary aerofoil shape. The aerofoil shapes are defined by two walls 11,12 constituting the sides of that shape and meeting at leading and trailing edges 13,14. Accordingly the vane comprises leading and trailing regions 15,16 meeting at junctions 17. The body has a third wall 18 (FIG. 2) which partly closes the interior void of the body at one spanwise end 19 at the leading region thereof. The other spanwise end 20 of the body 10 is open for the entry of cooling air.

The vane further comprises a first sheet metal insert 21 situated inside the void within the body 10 at the trailing region 16 of the vane. The insert 21 contacts small projections 39 which stand proud of the walls 11,12 so as to form air passages 30 between the insert 21 and the walls 11,12. The insert 21 comprises a single member having two perforate panels 22 extending over the full spanwise length of the walls 11,12. The panels converge towards the trailing edge of the aerofoil form and are in sealing engagement with the walls 11,12 at juctions 17. To ensure said sealing engagement, the walls 11,12 are provided with confronting grooves 23 into which a portion 22A adjacent panel 22 fits. The portion 22A comprises a single corrugation, or fold, the outer crest of which locates in the grooves 23 and the inner valley of which defines a groove 24. The grooves 24 confront each other and extend in a direction along the length of the aerofoil form. The space between the panels 22 is open at the spanwise ends of the insert 21 but as will be explained this space is closed at one spanwise end by a second insert 26.

The second insert 26 comprises a first panel 27 extending across the void in the body 10 and the edges of the second insert engage in the grooves 24 of the first insert 21 and close the space between the divergent ends of panels 22 at the junction 17. The panel 27 is therefore a partition between the leading and trailing regions 15,16 at the interior of the vane. The second insert 26 further has an integral second panel 28 extending approximately at right-angles to the panel 27 and such as to close the space between the panels 22 at one spanwise end 20 of the vane.

Figure 2:
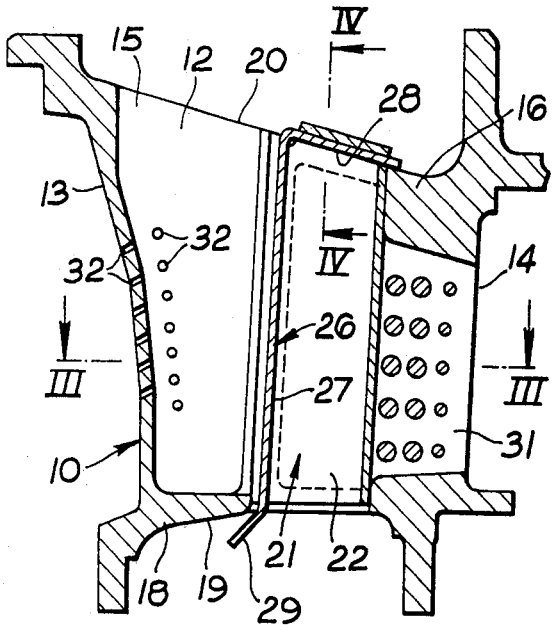
FIG. 2 is a sectional elevation of the vane of FIG. 1.
Figure 4:
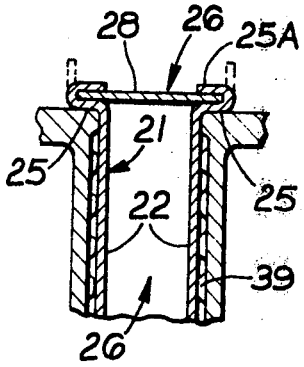
FIG. 4 is an enlarged section on the line IV—IV in FIG. 2.

The inserts 21 and 26 are assembled in the body 10 by first sliding the insert 21 in such a way that the beads 22A thereof slide down the grooves 23. The insert 21 has, at one spanwise end, shoulders 25 (FIG. 4) which abut the adjacent end of the body and limit the insertion of this insert. Thereafter the insert 26 is introduced by being slid into engagement with the grooves 24 until the panel 28 is seated on the shoulders 25. Thereafter, to ensure retention of the insert 26 the shoulders 25 are bent over as shown at 25A (FIG. 4) and the free end portion 29 of the panel 28 is bent over as shown in FIG. 2.

Cooling air supplied to the central voids can enter the space 30 between the inserts 21,26 at the spanwise end 19 of the vane, pass through the perforations of the panels 22 into a gap 30 (FIG. 3) between the panels 22 and the walls 11,12, and issue from apertures 31 in the trailing edge 14 of the vane. Air entering the central void in leading region of the vane at the end 20 issues through holes 32 at or near the leading edge 13.

The first and second inserts constitute an insert unit. The invention avoids the need for welding or brazing the components of this unit together, or of welding or brazing the unit to the vane. In consequence the unit can be detached from the vane simply by reversing the assembly sequence described and without the need to remove welded or brazed joints by machining. Further, the first insert 21 is suitable for vanes whose walls 11,12 are not parallel in the spanwise direction because the two panels 22 of this insert can be squeezed together to enable this insert to be inserted. An example of this is where the void within the body is wider at a location intermediate the ends of the body than at the ends of the body. That is to say, the void could have generally concave inner walls. In this case the panels 22 may be curved and squeezed together to facilitate insertion and allowed to spring open to engage the walls 11,12 and define a substantially uniform width between the insert 21 and the wall of the body 10.

Figure 5:
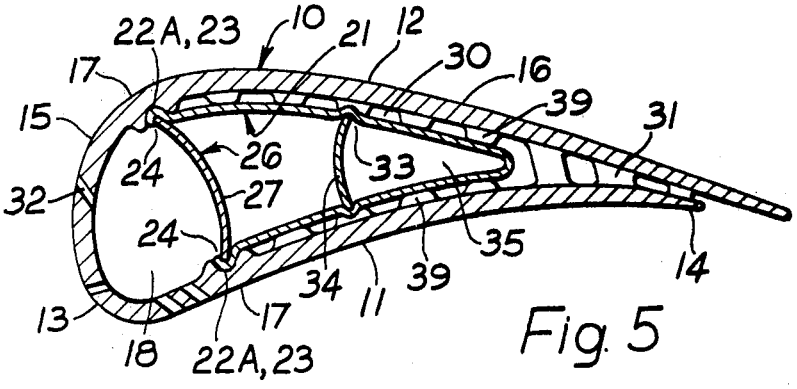
FIG. 5 illustrates a modification to the vane of FIG. 1.

In a further modification, shown in FIG. 5, the second insert 21 is provided with one or more additional spaced sets of confronting grooves 33, extending in a direction along the length of the aerofoil form, for receiving one or more additional inserts 34.

Figure 3:
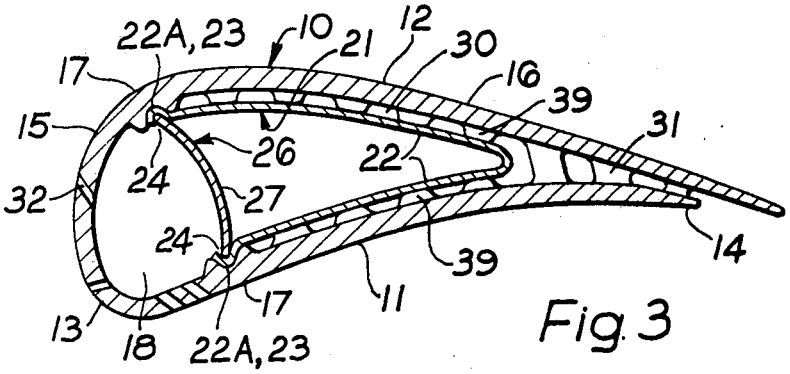
FIG. 3 is an enlarged section on the line III—III in FIG. 2.

The inner wall may also be provided with similar grooves (not shown) but which are similar to the grooves 24 shown in FIG. 3, and the first insert 21 may be provided with beads (not shown) similar to that described in connection with FIG. 3. However, it may not be necessary to provide additional grooves in the wall of the body 10 providing the additional inserts are a tight enough fit to force the first insert 21 against the wall of the body 10.

The, or each, insert 34, (only one of which is shown) extends across the void in the body 10 and effectively divides the void rearwards of the panel 27 of the second insert 26 into a number of chambers 35.

The shape of the second panel 28 of the second insert 26 may be modified so that at one end of the body only alternate chambers 35 are blocked off. In this case, the inserts 34 may comprise a second panel 36 to block off the other end of the other chambers 35 not blocked off by the panel 28 of the second insert. If desired, instead of modifying the shape of the panel 28, the panel 28 may block off all the chambers 35 to the rear of the panel 27 along one end of the body and holes (not shown) provided in the inserts 36.

The first insert 21 is described above as being made from a single member. If desired it may be made from two or more members, which are connected together. For example each panel 22 may constitute a single member and the two members may be connected together at the trailing edge 14 of the vane by suitable interlocking or co-operating parts, thereby effectively to form a single first insert 21 when in place within the void in the body 10.

We claim:

1. A vane for a gas turbine engine, the vane comprising: a hollow body externally of aerofoil form, the inner surface of which is provided with confronting grooves extending in a direction along the length of the aerofoil form at a location intermediate the leading and trailing edges of the aerofoil form; a first insert comprising two perforated panels situated inside a trailing region of the aerofoil form and defining therewith one or more air passages between the insert and the wall of the body, the first insert having portions which engage in the grooves in the wall of the body, and the first insert being provided with confronting grooves extending in a direction along the length of the aerofoil form at a location intermediate the leading and trailing edges of the aerofoil form; and a second insert comprising a first panel extending across the void in the body, the second insert having edges which engage in the confronting grooves in the first insert and having a second panel closing at least part of an end of the void in the body.

2. A vane according to claim 1 wherein the void within the hollow body is of approximately aerofoil shape complementary to the exterior aerofoil form, the two panels of the first insert converge towards the trailing edge of the aerofoil form, and the first panel of second insert extends across between the diverging edges of the first insert.

3. A vane according to claim 1 wherein the first insert comprises a single member.

4. A vane according to claim 1 wherein the first insert comprises two or more components which are connected together.

5. A vane according to claim 1 wherein the void within the body is wider at a location intermediate the ends of the body than at the ends of the body and the panels of the first insert are shaped to conform to the internal shape of the void so as to define a substantially uniform gap between the first insert and the wall of the body.

6. A vane according to claim 1 wherein the first insert is provided with one or more additional spaced sets of confronting grooves extending in a direction along the length of the aerofoil form, and one or more additional inserts are provided which extend across the void within the body to engage in the, or each, set of additional grooves.

7. A vane according to claim 1 or wherein the hollow body has an end wall effectively closing off at least part of one end of the void inside the body.

8. A vane according to claim 7 wherein the end wall effectively closes off one end of the void formed at the leading edge side of the first panel of the second insert and the second panel of the second insert effectively closes off the void formed at the trailing edge side of the first panel of the second insert at an end of the body opposite to that at which the said end wall is provided.

* * * * *